US007296568B2

(12) United States Patent
Capon et al.

(10) Patent No.: US 7,296,568 B2
(45) Date of Patent: Nov. 20, 2007

(54) RESPIRATOR MODULE WITH SPEECH TRANSMISSION AND EXHALATION VALVE

(75) Inventors: Andrew Capon, Salisbury (GB); Tim John Maclean, Bath (GB)

(73) Assignee: Avon Protection Systems, Inc., Cadillac, MI (US)

( * ) Notice: Subject to any disclaimer, the term of this patent is extended or adjusted under 35 U.S.C. 154(b) by 828 days.

(21) Appl. No.: 10/484,342

(22) PCT Filed: Jul. 16, 2002

(86) PCT No.: PCT/US02/22591

§ 371 (c)(1),
(2), (4) Date: Jan. 16, 2004

(87) PCT Pub. No.: WO03/008043

PCT Pub. Date: Jan. 30, 2003

(65) Prior Publication Data

US 2005/0022819 A1 Feb. 3, 2005

Related U.S. Application Data

(60) Provisional application No. 60/306,333, filed on Jul. 18, 2001.

(51) Int. Cl.
*A62B 18/08* (2006.01)

(52) U.S. Cl. ..... 128/201.19; 128/206.17

(58) Field of Classification Search ..... 128/201.19, 128/201.23, 201.25, 201.27, 201.28, 202.15, 128/205.27, 205.28, 206.12, 206.13, 206.14, 128/206.15, 206.17, 206.21, 206.23, 206.24, 128/206.28, 206.29, 207.11, 207.12
See application file for complete search history.

(56) References Cited

U.S. PATENT DOCUMENTS

| | | | | |
|---|---|---|---|---|
| 3,348,537 | A * | 10/1967 | Buban et al. | 128/201.19 |
| 3,575,206 | A | 4/1971 | Ulmann | |
| 3,645,261 | A | 2/1972 | West | |
| 4,373,520 | A | 2/1983 | Arbique | |
| 4,712,594 | A | 12/1987 | Schneider | |
| 4,736,740 | A | 4/1988 | Parker et al. | |
| 4,869,244 | A | 9/1989 | Nentchev | |
| 4,958,633 | A | 9/1990 | Angell | |
| 5,101,816 | A | 4/1992 | Wilcox | |
| 5,224,474 | A | 7/1993 | Bloomfield | |
| 5,385,141 | A | 1/1995 | Granatiero | |
| 5,454,375 | A | 10/1995 | Rothenberg | |
| 5,463,693 | A | 10/1995 | Birli et al. | |
| 5,662,142 | A | 9/1997 | Ansite | |

(Continued)

*Primary Examiner*—Teena Mitchell
(74) *Attorney, Agent, or Firm*—McGarry Bair PC

(57) ABSTRACT

A respirator speech transmitter and exhalation valve module comprising a resilient exhalation valve having a low airflow resistance for exhalation but providing a secure seal against inadvertent inhalation through the exhalation valve module. An exhalation airflow channel is formed between a module body on the outside of the channel and a conical airflow guide and the exhalation valve on the inside of the channel. The exhalation airflow channel is in the form of an amplification horn. The airflow channel produces a smooth airflow for unrestricted exhalation and high intelligibility of a user's speech. The module includes a drinking conduit for selectively fluidly connecting a mouthpiece in the respirator to a beverage container and further includes an electrical communication block with internal and external fittings for connecting a microphone in the mask to a radio or amplifier carried by the mask user.

31 Claims, 9 Drawing Sheets

U.S. PATENT DOCUMENTS 5,971,723 A 10/1999 Bolt et al.
6,121,881 A * 9/2000 Bieback et al. ..... 340/573.1
6,176,239 B1 1/2001 Grove et al.
6,305,370 B1 10/2001 Rosert et al.
6,997,178 B1 * 2/2006 Reynaud ..... 128/201.19
2005/0172959 A1 * 8/2005 Williams ..... 128/201.19

* cited by examiner

RESPIRATOR MODULE WITH SPEECH TRANSMISSION AND EXHALATION VALVE

CROSS-REFERENCE TO RELATED APPLICATIONS

This application claims priority on International Application No. PCT/US02/22591, filed Jul. 16, 2002, which claims the benefit of U.S. Provisional Patent Application Ser. No. 60/306,333, filed Jul. 18, 2001.

GOVERNMENT INTEREST

This invention was made with government support under DAAD13-00-C-0021 by the Department of Defense (US Special Operations Command). The government has certain rights in this invention.

BACKGROUND OF INVENTION

1. Field of the Invention

The invention relates to a respirator with a module that includes a speech transmission and exhalation valve functions. In one of its aspects, the invention relates to a respirator module incorporating an exhalation valve, a speech transmitter and a drinking tube. In another of its aspects, the invention relates to a respirator speech transmission module with integral electrical connections for communications devices. In another of its aspects, the invention relates to a respirator with a speech transmission and an exhalation valve module. In yet another of its aspects, the invention relates to a respirator and speech transmitter module therefore with low airflow resistance through the module.

2. Description of the Related Art

When a respirator such as a gas mask is used in a contaminated environment, it is critical that the wearer only inhale air from a purified source or air that has been passed through a filtration canister. In the typical gas mask having removable filtration canisters, the filtration canisters are attached to a filter mount including an inhalation valve that provides for one-way flow, opening during inhalation and closing during exhalation to prevent exhalation of hot, moisture-laden air through the filter.

It is important that the inhalation valve introduce no restrictions in the airflow path that will put additional strains on the wearer. In like fashion, it is important that an exhalation valve has minimal restrictions in the exhalation airflow but has secure sealing during inhalation. As the inhalation valve must have a low-opening pressure, the exhalation valve must also have a low-opening pressure to reduce the burden on the wearer and the likelihood of breaking the seal of the respirator.

Further, it is important that the wearer has the ability to communicate clearly with others in the vicinity or by radio while the respirator is in place and functioning in the contaminated environment. It is therefore advantageous for an exhalation module to have low-resistance opening during wearer exhalation, complete sealing during wearer inhalation and with high intelligibility of wearer speech.

U.S. Pat. No. 4,958,633, issued Sep. 25, 1990, to Angell, discloses a respirator with a speech and exhalation module incorporating an elastomeric exhalation valve. The exhalation valve is constructed of resilient material in a generally dished form anchored at a central portion and adapted to seal on a peripheral edge onto a valve seat on the module housing. The exhalation valve has an annular channel, formed by an annular arcuate section and that faces the outside of the mask. The module forms an air path in the form of an exponential horn between the inside and outside of the mask. The air path reverses axial direction between the inlet and the outlet, creating some turbulence. The speech module and exhalation valve have a fairly low resistance to exhalation, in the range of about 15 mm at 85 l/min air flow. The respirator also has interchangeable mountings on the face piece for a secondary speech outlet, such as a microphone, and for an air-purifying canister. The speech transmitter module is disclosed more fully in the U.S. Pat. No. 4,539,983, issued Sep. 10, 1985, to Angell. These two Angell patents are incorporated herein by reference in their entirety.

SUMMARY OF THE INVENTION

The invention relates to a respirator and a front module therefor as set forth in the preamble to claim 1 and wherein the inner side wall of the module body forms with the airflow guide an airflow channel in the form of a horn expansion contour during exhalation when the outlet valve is in an open position. The airflow channel from the interior to the exterior of the module extends radially and axially outwardly, then bends radially inwardly and axially outwardly through a smooth curve and then bends through a smooth curve axially outwardly. The airflow pattern does not reverse direction and thus has a very low resistance. In one embodiment, the outlet valve forms a part of the airflow channel with the inner side wall of the module body.

In one embodiment, the form of the horn expansion is conical, exponential, hyperbolic, tractrix or a combination thereof. In a preferred embodiment, the airflow guide has a generally conical surface facing the outer face of the module. In addition, the airflow guide conical surface is concave and the airflow guide has a relatively flat bottom surface facing the inner face of the module. An outer edge of the exhalation valve abuts the bottom surface of the airflow guide when the exhalation valve is in the open position. In one embodiment of the invention, the bottom surface of the airflow guide has relief channels to prevent sticking of the exhalation valve in the open position.

The invention also relates to a respirator and a front module therefor as set forth in the preamble to claim 1 and wherein the outlet valve has a dome shape with a central body and a generally conical skirt. In one embodiment, the outlet valve conical skirt is slightly convex outwardly toward the outer face of the module body. Further, the outlet valve further has convex shoulder hinge between the central body and the conical skirt to toggle the outlet valve between an open position and a closed position. Still further, the convex shoulder hinge forms a channel that opens toward the inner face of the module body.

The invention further relates to a respirator and a front module therefor as set forth in the preamble to claim 1 and wherein the module further includes an electrical communication block with internal and external fittings for connecting a microphone in the mask to a radio or amplifier carried by the mask user.

DESCRIPTION OF THE PREFERRED EMBODIMENT

Figure 1:
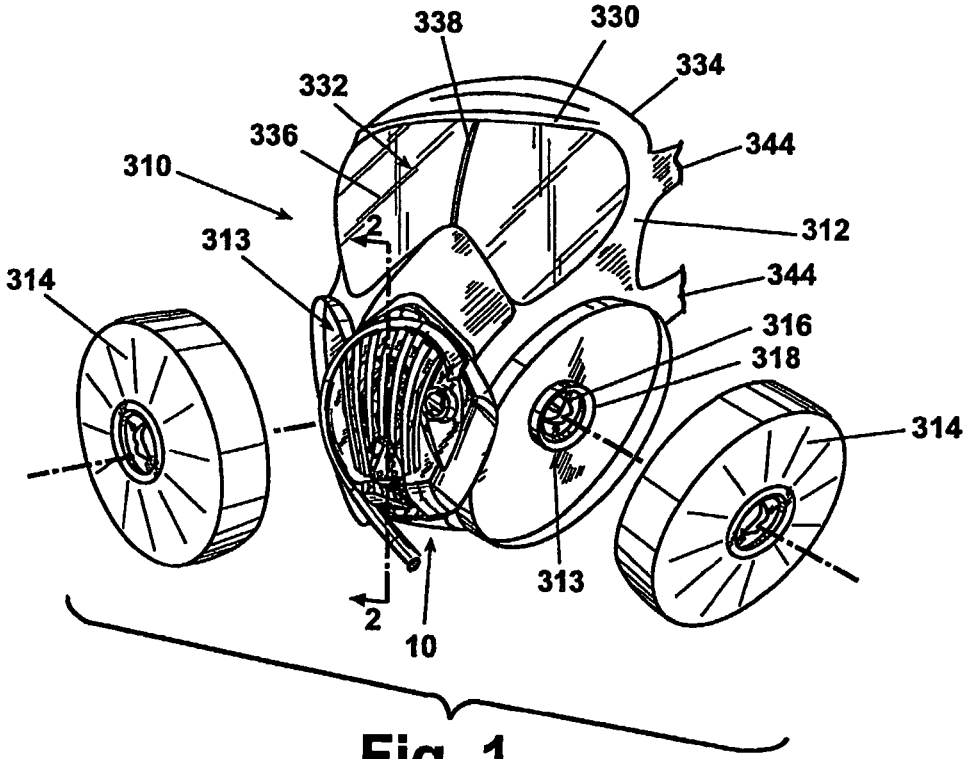
FIG. 1 is a front view of a respirator with a respirator speech transmitter and exhalation valve module according to the invention.
Figure 2:
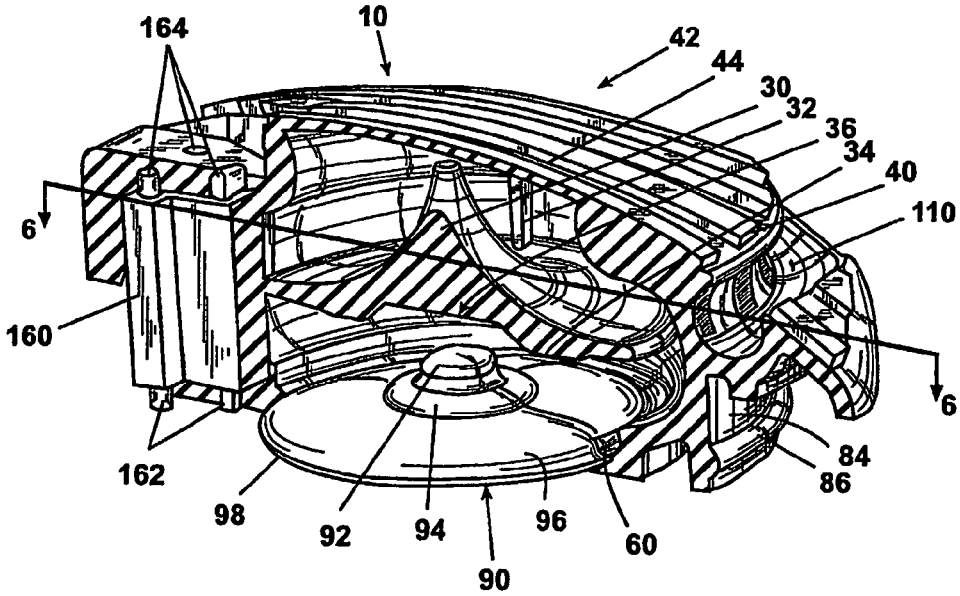
FIG. 2 is a partial cross-sectional view in perspective taken through line 2-2 of the respirator speech transmitter and exhalation valve module of FIG. 1.
Figure 3:
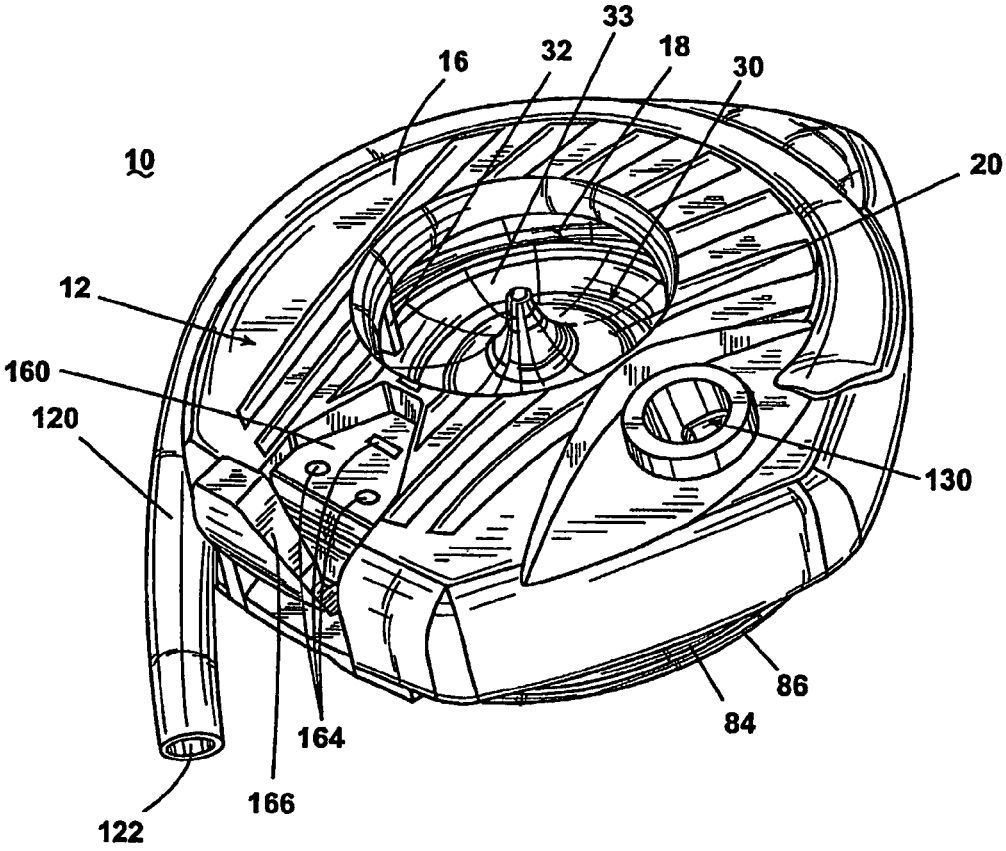
FIG. 3 is a perspective view of the outside of the speech transmitter and exhalation valve module shown in FIGS. 1 and 2 with portions of the outer surface removed for illustration of the interior of the module.
Figure 4:
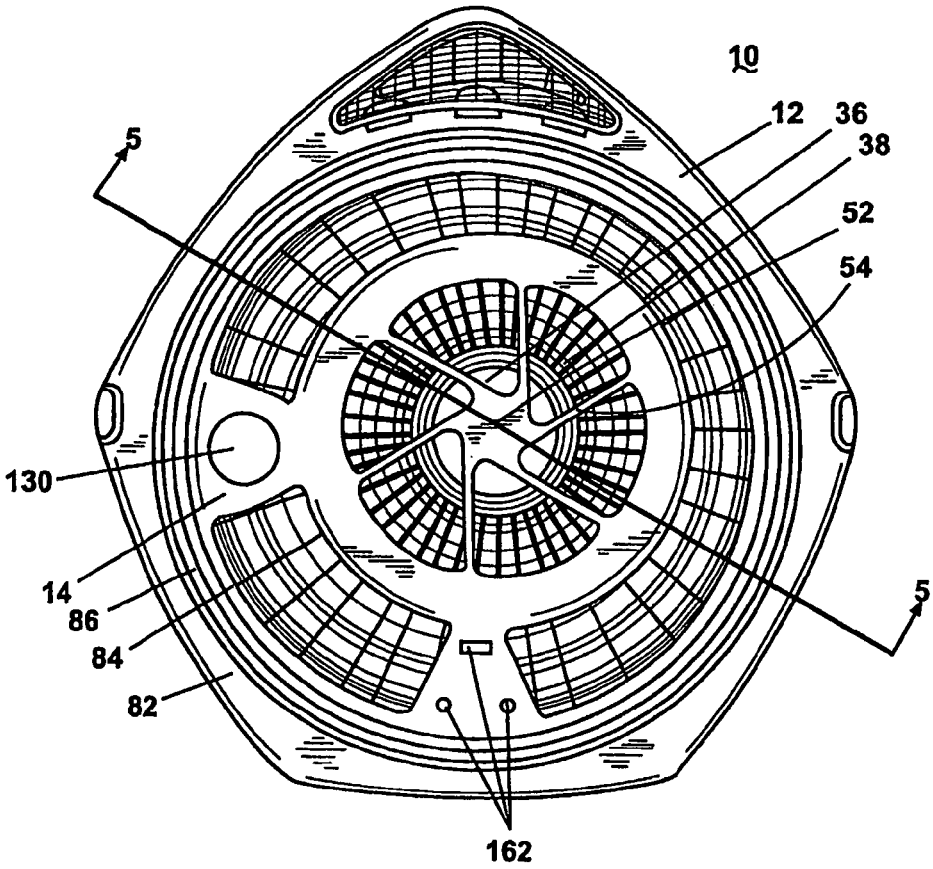
FIG. 4 is a plan view of the inner face of the respirator speech transmitter and exhalation valve module of FIGS. 1-3.

Referring to the drawings and to FIG. 1 in particular, a gas mask or respirator assembly 310 comprises a mask 312 having a facepiece 330 that fits onto a user's face and defines an interior chamber, a visor 332 comprising a transparent polyurethane panel 336, or panels, that may or may not have a central elastomeric hinge 338, a pair of circular or elliptical filter canisters 314 each mounted to the mask 312 at a canister mount 313.

Facepiece 330 is held to a user's face by a plurality of low-profile harness straps 344 defining a seal at facepiece periphery 334 that eliminates hot spots and fits comfortably with a helmet. Harness straps 344 can be folded over the exterior of facepiece 330 to aid user in rapidly donning mask 312. The interior chamber of mask 312 further comprises a nose cup (not shown) that is formed of a suitable material such as silicone or polyisoprene and is provided in multiple sizes for comfort and fit on different users.

The canister mounts 313 each include an inlet port and self-sealing mechanism assembly 316 and a connector 318 for affixing the circular or elliptical filter canisters 314 to mask 312.

The assembly 310 further comprises a front module 10 that includes speech transmission and exhalation valve functions affixed to mask 312. Module 10 combines and integrates the functions of speech, drinking system, outlet valve assembly and electrical communication.

Referring now to FIGS. 2-7 in particular, front module 10 includes a module body 12 having an inner face 14, an outer face 16 and a central cavity 18 defined by a smooth and continuous side wall. A conical airflow guide 30 is supported within the cavity 18 by a number of airflow guide struts 32 that are connected to the airflow guide 30 and to the side wall of the central cavity 18 to hold the conical airflow guide substantially centered within the central cavity 18. The conical airflow guide has a concave upper surface 33 and a relatively flat lower surface. The module body 12 further includes a peripheral shoulder 80 having a facepiece engaging surface 82 for mounting the module 10 to the facepiece 312 of a respirator (FIG. 1). A skirt 84 extending from the peripheral shoulder 80 is mounted in a conforming opening in a facepiece adapted to receive the speech transmitter module 10. The skirt 84 includes a circumferential bead 86 for assisting in retaining the module 10 in the facepiece opening and further provides a retention means for a nosecup within the respirator facepiece.

Figure 5:
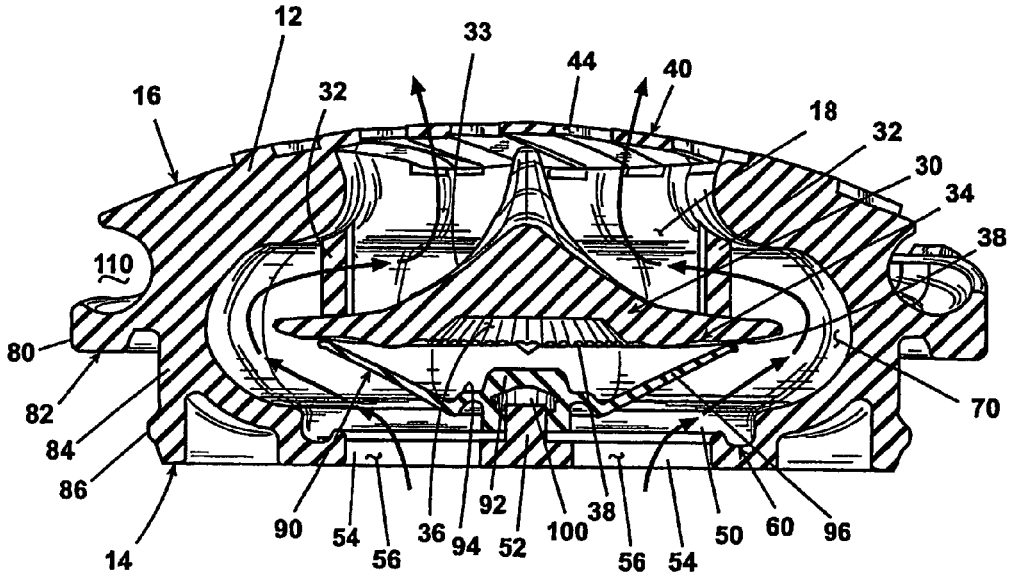
FIG. 5 is a cross sectional view taken along lines 5-5 of FIG. 4
Figure 6:
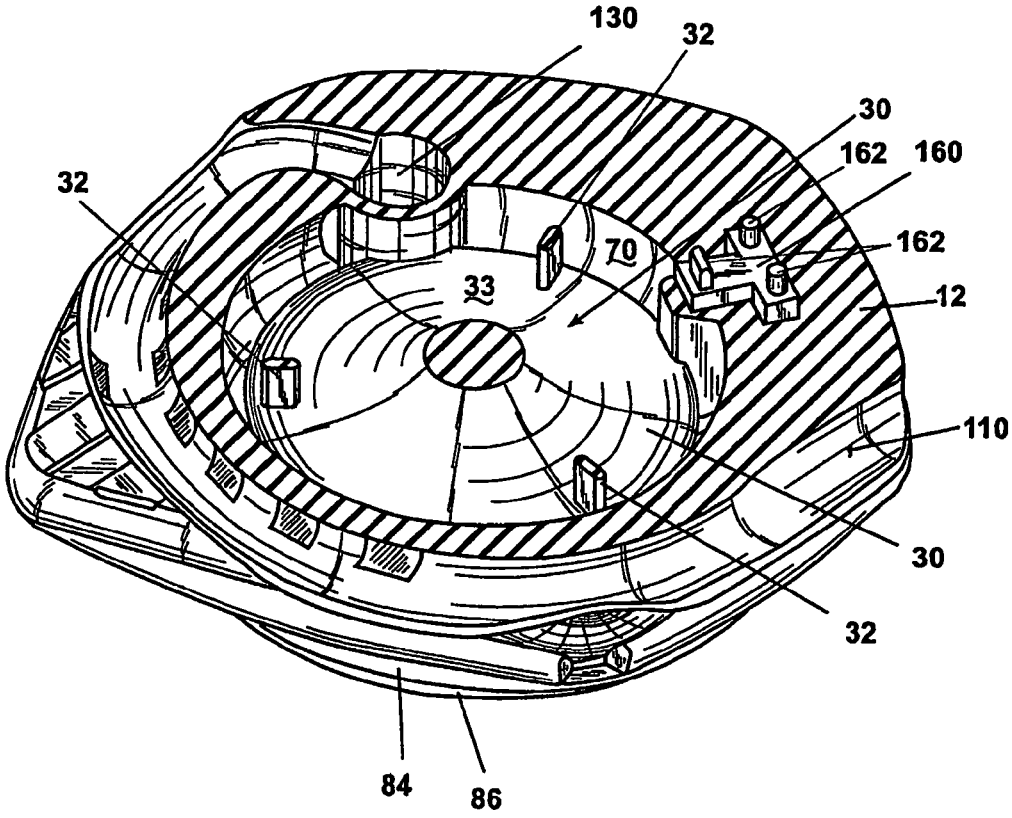
FIG. 6 is a cross-sectional view taken through line 6-6 of FIG. 2.
Figure 7:
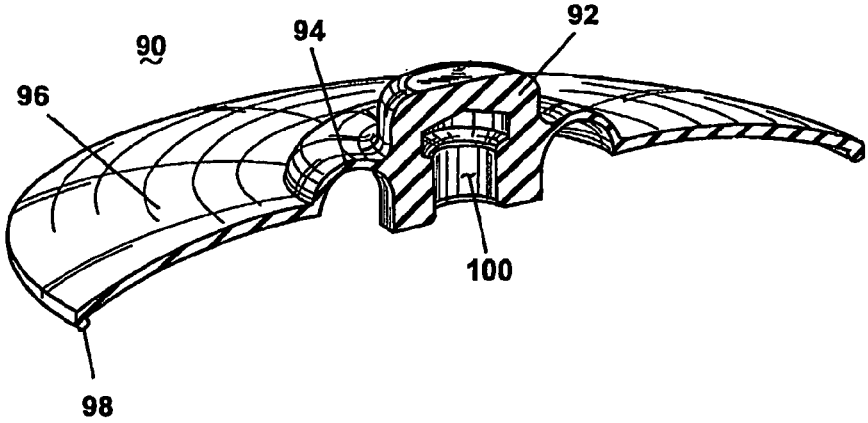
FIG. 7 is a cross-sectional view in perspective of the domed outlet valve used in the respirator speech transmitter and exhalation valve module of FIGS. 1-6.
Figure 8:
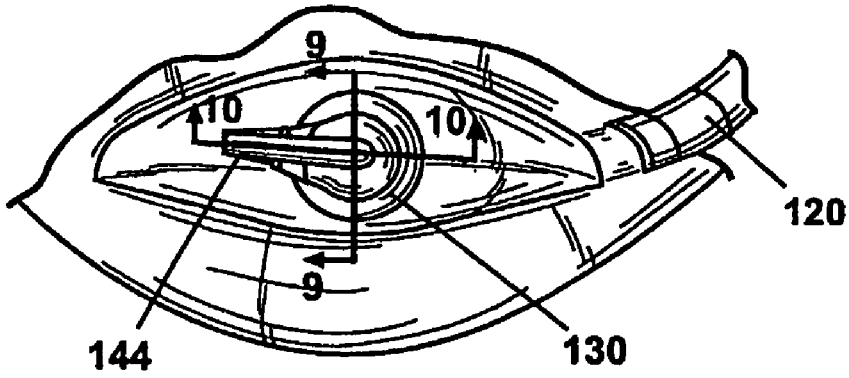
FIG. 8 is a partial enlarged view of a drinking tube valve of the respirator speech transmitter and exhalation valve module of FIGS. 1-7.

The central cavity 18 provides a flow path, illustrated by the arrows in FIG. 5, between an inlet opening 50 at the inner face 14 of the mask to an outlet opening at the outer face 16 of the mask through slots 44. The outer face 16 of the module body 12 includes a plurality of slats 40 defining an outer face grille 42. The slats 40 are not shown in FIG. 3 so that the conical airflow guide 30 can be seen in the cavity 18. The air flows between the inside and outside of the module body 12 through slots 44 defined between the slats 40 of the grille 42.

At the inner face 14 of the module body 12, the cavity 18 includes the substantially circular opening 50 defined by an annular valve seat 60 for fluidly connecting the cavity 18 to the inner face 14 of the module body 12. The circular opening 50 is surrounded at the base of central cavity 18 of the module body 12 by the annular valve seat 60.

An outlet valve attachment stud 52 is mounted to the annular valve seat 60 in a central portion of the circular opening 50 through a plurality of spokes 54. The valve attachment stud 52 and spokes 54 define a number of airflow apertures 56 for fluidly connecting the cavity 18 to the outside of the module body 12 at the inner face 16.

The side wall of the cavity 18 and the upper surface 33 of the conical airflow guide 30 define the airflow channel 70 through the module body 12 from the airflow apertures 56 at the inner face 14 of the module body 12 to the slots 44 at the outer face 16 of the module body 12. The airflow channel 70 defines a horn expansion contour that enhances the sound transmitted by a user through the speech module. The form of the horn expansion can be conical, exponential, hyperbolic, tractrix or a combination of theses forms. As illustrated in FIG. 5, the airflow pattern between the airflow apertures 56 and the slots 44 follows a smooth, continuous route without any reversal of direction. The airflow pattern begins in a radial outward and axial direction and then bends smoothly in a radially inward and axial outward direction and then smoothly turns axially outwardly.

The outlet valve attachment stud 52 mounts a domed outlet valve 90. The domed outlet valve 90 includes a central cylindrical body 92 surrounded by an outwardly convex shoulder hinge 94 and an umbrella-like skirt 96 having a ribbed, weighted perimeter 98. The skirt 96 is convex outwardly slightly toward the outer face 16 of the module body 12. The shoulder hinge 94 forms an open channel of generally semi-circular cross-section and the channel opening faces the inside of the module and the respirator. The central cylindrical body 92 includes a stud-receiving cavity 100 adapted to closely receive the outlet valve attachment stud 52.

The outlet valve attachment stud 52 is positioned centrally within the circular opening 50 and directed into the cavity 18. The domed outlet valve 90 is configured such that with the outlet valve attachment stud 52 received in the cavity 100 of the central body 92 of the domed outlet valve 90, the ribbed perimeter 98 of the domed outlet valve 90 is sealingly received in the annular valve seat 60.

The domed outlet valve 90 is resilient and biased toward a closed position with the perimeter 98 of the outlet valve 90 pressed against the annular valve seat 60 within the central cavity 18 of the module body 12 to form an airtight seal.

This configuration eliminates the possibility that the outlet valve 90 will be drawn inside out during an inhalation process. As the wearer exhales, the domed outlet valve 90 rolls up the hinge 94 and then inverts so that it abuts the base 34 of the conical airflow guide 30. The convex shoulder hinge 94 functions as a rolling toggle mechanism to flip the valve very wide open at the lowest possible positive (exhalation) pressure and closing quickly when the exhalation pressure drops near zero. The domed or umbrella shape of the valve is designed such that more energy is stored in the valve when inverted and this helps to revert the valve back rapidly to the closed position. This rolling hinge action represents a major change over cone-shaped valves that have a tendency to be lazy and not to revert as rapidly. The opening and closing of the outlet valve 90 takes place very quickly when the pressure changes from positive to negative. The harder the work rate, the more rapid and deep is the pressure change as the airflow volume increases per breath. The valve 90 accommodates a wide variety of changes very quickly.

The base 34 of the airflow guide 30 is formed with a central depression 36 and a series of radial relief channels 38. The relief channels or grooves 38 prevent the skirt 96 of the outlet valve 90 from sticking to the base 34 by surface tension from breath moisture and forming an airtight seal when the valve is forced up against the base during exhalation.

The inverted outlet valve 90 cooperates with the conical airflow guide 30 to create an unobstructed airflow channel 70 through the cavity 18 of the module body 12. Exhalation air (shown by arrows) flows from the interior of the respirator through the airflow apertures 56 at the inner face 14 of the module body 12. The exhalation air then passes by the inverted outlet valve 90 and around the conical airflow guide 30, through the airflow channel 70, and through the slots 44 in the outer face 16 of the module body 12. Exhalation air in the form of speech by the wearer passes through the airflow channel 70 in a like manner; the expansion contour of the horn form of the airflow channel enhances the intelligibility of the wearer's speech.

The surfaces of the side wall of the cavity 18 and the skirt 96 of the domed valve 90 at the inner portion of the module and the side wall of the cavity 18 and the upper surface 33 of the conical airflow guide 30 define an expanding airflow channel in a smooth continuous horn pattern between the airflow apertures 56 and the slots 44 to amplify the speech from the user and to minimize the flow resistance through the airflow channel. The airflow through the airflow channel has very little, if any, turbulence and yet has a very low dynamic leakage due to the sensitivity of the exhalation valve. The combination of the low resistance domed valve 90 and the smooth, axially non-reversing and continuously expanding horn airflow passage walls minimize the airflow resistance through the airflow passage to a very low value. For example, it has been found that the flow resistance to airflow through the airflow channel 70 is a little as 6 mm water gauge at 85 l/min with the configuration illustrated in the drawings and described above.

As the wearer of the respirator completes his exhalation, the outlet airflow rate decreases until it can no longer overcome the bias in the outlet valve 90. The outlet valve 90 then returns to its naturally biased position and forms a seal against the annular valve seat 60. As the wearer of the respirator inhales, the outlet valve 90 is firmly seated in the annular valve seat 60 and prevents the infiltration of inhalation air through the outlet airflow apertures 56.

The central cavity 18 is protected from the impingement of solid matter by the outer face grille 42. The domed outlet valve 90 is further shielded from the outer face 16 of the module body 12 by the conical airflow guide 30. The domed outlet valve 90 is not visible from the outer face 16 of the module body 12 through the outer face slots 44.

The respirator speech transmitter and exhalation valve module 10 further includes a drinking tube storage channel 110 for storing a drinking tube 120 on the exterior of the module 10. The drinking tube 120 has a distal end 122 for connecting to a fluid source such as a water bottle and a proximal end 124 for fluidly connecting to a drinking tube hole 130 passing through the module body 12.

Figure 9:
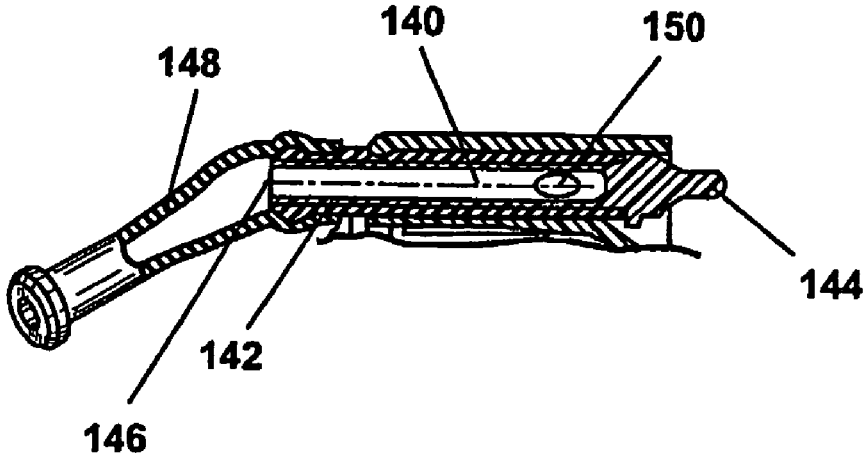
FIG. 9 is a cross-sectional view taken through line 9-9 of FIG. 8.
Figure 10:
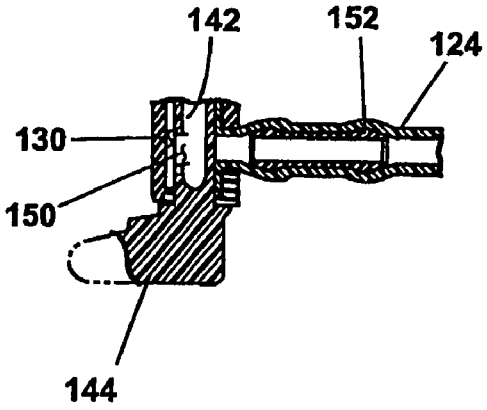
FIG. 10 is a cross-sectional view taken through line 10-10 of FIG. 8 with the drinking tube valve in the closed position.
Figure 11:
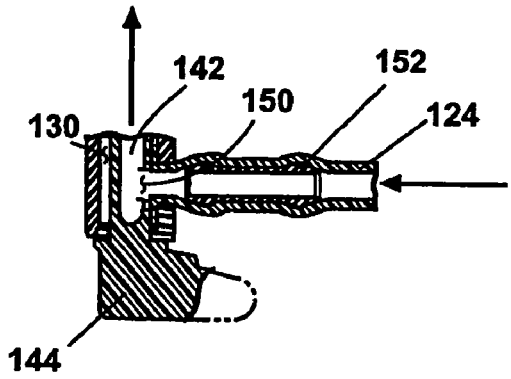
FIG. 11 is a cross-sectional view like FIG. 10.

The drinking tube hole 130 is selectively sealed by a drinking tube valve 140 shown in FIGS. 8-11. The drinking tube valve 140 includes a blind end hollow tube 142 having an activation tap lever 144 for placement on the outside of the module body 12. The inner end 146 of the drinking tube valve 140 is adapted for fitting a mouthpiece 148 enabling a wearer of a respirator to drink from the water bottle. The drinking tube valve 140 includes an opening 150 in a side of the hollow tube 142 for selectively fluidly connecting the mouthpiece 148 to the proximal end 124 of the drinking tube 120. The drinking tube 120 is secured on a fitting 152 fluidly connected to the drinking tube hole 130. With the drinking tube valve 140 in the closed position as shown in FIG. 9, the fitting 152 and drinking tube 120 are fluidly isolated from the mouthpiece 148. When the drinking tube valve 140 is moved to the open position as shown in FIG. 11, the hole 150 in the side of the tube 142 is aligned with the fitting 152 to fluidly connect the drinking tube 130 with the mouthpiece 148. As the drinking tube valve 140 is rotated from the closed to the open position, the mouthpiece 148 simultaneously moves from a stored position away from the wearer's mouth to a position accessible to the wearer.

The module body 12 further incorporates an integrally molded communication connector block 160 for providing an electrical and communication connection between the inner and outer faces 14, 16 of the module body 12. The connector block 160 is preferably integrally molded with the module body 12 and can be used for attaching a microphone (not shown) to internal terminal connectors 162 on the inner face 14 of the module body 12. The microphone can be electrically powered with the use of all three terminal connectors 162 or unpowered with the use of only two of the terminal connectors 162. A communications device, such as a radio or an amplifier (not shown) carried by the respirator user, can be connected to the external terminal connectors 164 on the outer face of the module body 12. All three terminal connectors 164 can be used to connect electrical power to the interior microphone. Alternatively, only two of the terminal connectors 164 can be used to connect the radio or amplifier to an unpowered microphone. The connector block 160 is also provided with an integrally molded connector block cover 166 for protecting the external connectors 164 when not in use.

In use, the respirator speech transmitter and exhalation valve module 10 provides an exhalation valve and airflow management for a respirator and provides a conduit through which the wearer of the respirator can intelligibly speak. For face-to-face conversation the wearer's voice is carried through the outlet airflow charmer 70. For electronic communication, the wearer's voice can be carried through the outlet airflow channel 70 to an external microphone, or the wearer can use an internal microphone electrically connected to the internal connectors 162 with the electronic communication device electrically connected to the external connectors 164. The module 10 provides pass-through connectors for a microphone and electronic communication. The module 10 further provides an attachment location for the nose cup as part of the airflow management process. Still further, the module 10 incorporates a drink tube connection to the mask and provides a convenient parking place for the drink tube. The module 10 has a low dynamic leakage while a very low flow resistance due to the smooth flow of the airflow through the air passage in the module.

While the invention has been specifically described in connection with certain specific embodiments thereof, it is to be understood that this is by way of illustration and not of limitation. Reasonable variation and modification are possible within the scope of the forgoing description and drawings without departing from the spirit of the invention which is defined in the appended claims.

What is claimed is:

1. A respirator comprising a facepiece defining an interior chamber for filtered air and including at least one inhalation opening for passage of filtered air from the atmosphere to the interior chamber; at least one exhalation opening for passage of air from the interior chamber to the atmosphere; and a filtration canister removably mounted to the facepiece and in fluid communication with the at least one inhalation opening for passage of purified atmospheric air to the facepiece interior chamber;

a self-sealing valve mounted in the at least one inhalation opening and adapted to seal the at least one inhalation opening to prevent inhalation of air therethrough when the filtration canister is removed from the facepiece and to open the at least one inhalation opening to permit inhalation of air therethrough when the filter canister is mounted to the facepiece; and a speech transmitter and exhalation valve module mounted in the at least one exhalation opening and adapted to seal the at least one exhalation opening to prevent inhalation of air therethrough and to open the at least one exhalation opening to permit exhalation of air therethrough, the speech transmitter and exhalation valve module comprising:

a module body having an inner face, an outer face and an outer wall;

a airflow cavity defined by an inner side wall of the module body and extending between openings in the inner and outer faces of the module for fluidly connecting the inner face and the outer face;

an airflow guide positioned within the airflow cavity; and an outlet valve, mounted to the module body and in the airflow cavity, and adapted to close and fluidly seal the airflow cavity during inhalation and to open during exhalation, characterized in that:

the inner side wall of the module forms with the airflow guide and the outlet valve an airflow channel in the form of a horn expansion contour during exhalation when the outlet valve is in an open position.

2. A respirator according to claim 1 wherein the form of the horn expansion is conical, exponential, hyperbolic, tractrix or a combination thereof.

3. The respirator of claim 1 wherein the airflow channel from the interior to the exterior of the module extends radially and axially outwardly, then bends radially inwardly and axially outwardly through a smooth curve and then bends through a smooth curve axially outwardly, and does not reverse axial direction.

4. The respirator of claim 1 and further comprising a drinking tube for selectively fluidly connecting a mouthpiece projecting from the inner face of the module body to a beverage container adjacent the outer face of the module body.

5. The respirator of claim 1 wherein the outlet valve has a dome shape with a central body and a generally conical skirt.

6. The respirator according to claim 5 wherein the outlet valve conical skirt is slightly convex outwardly toward the outer face of the module body.

7. The respirator of claim 5 wherein the outlet valve further has convex shoulder hinge between the central body and the conical skirt to toggle the outlet valve between an open position and a closed position.

8. The respirator of claim 7 wherein the convex shoulder hinge forms a channel that opens toward the inner face of the module body.

9. The respirator according to claim 1 wherein the airflow guide has a generally conical surface facing the outer face of the module.

10. The respirator according to claim 9 wherein the airflow guide conical surface is concave.

11. The respirator of claim 9 wherein the airflow guide has a relatively flat bottom surface facing the inner face of the module.

12. The respirator of claim 11 wherein an outer edge of the exhalation valve abuts the bottom surface of the airflow guide when the exhalation valve is in the open position.

13. The respirator of claim 12 wherein the bottom surface of the airflow guide has relief channels to prevent sticking of the exhalation valve in the open position.

14. The respirator of claim 1 wherein the module further includes an electrical communication block with internal and external fittings for connecting a microphone in the mask to a radio or amplifier carried by the mask user.

15. A speech transmitter and exhalation valve module adapted for mounting in an exhalation opening of a respirator and adapted to seal the exhalation opening to prevent inhalation of air therethrough and to open the exhalation opening to permit exhalation of air therethrough, the speech transmitter and exhalation valve module comprising:

a module body having an inner face and an outer face;

a central cavity for fluidly connecting the inner face and the outer face;

an airflow guide positioned within the central cavity, wherein the airflow guide forms with the module body an airflow channel in the form of a horn expansion contour during exhalation; and an outlet valve adapted to close and fluidly seal the central cavity from the inner face during inhalation and to open during exhalation, characterized in that:

the airflow channel from the interior to the exterior of the module extends radially and axially outwardly, then bends radially inwardly and axially outwardly through a smooth curve and then bends through a smooth curve axially outwardly, and does not reverse axial direction.

16. The module of claim 15 wherein the form of the horn expansion is conical, exponential, hyperbolic, tractrix or a combination thereof.

17. The module of claim 15 wherein the outlet valve has a dome shape with a central body and a generally conical skirt.

18. The module according to claim 17 wherein the outlet valve conical skirt is slightly convex outwardly toward the outer face of the module body.

19. The module of claim 17 wherein the outlet valve further has convex shoulder hinge between the central body and the conical skirt to toggle the outlet valve between an open position and a closed position.

20. The module of claim 19 wherein the convex shoulder hinge forms a channel that opens toward the inner face of the module body.

21. The module of claim 15 wherein the outlet valve forms a part of the airflow passage when it is in the open position.

22. The module of claim 15 and further including an electrical communication block with internal and external fittings for connecting a microphone in the mask to a powered transmitter carried by the mask user.

23. The module according to claim 15 wherein the airflow guide has a generally conical surface facing the outer face of the module.

24. The module of claim 23 wherein the airflow guide has a relatively flat bottom surface facing the inner face of the module.

25. The module of claim 24 wherein an outer edge of the exhalation valve abuts the bottom surface of the airflow guide when the exhalation valve is in the open position.

26. The module of claim 25 wherein the bottom surface of the airflow guide has relief channels to prevent sticking of the exhalation valve in the open position.

27. A respirator comprising a facepiece defining an interior chamber for filtered air and including at least one inhalation opening for passage of filtered air from the atmosphere to the interior chamber; at least one exhalation opening for passage of air from the interior chamber to the atmosphere; and a filtration canister removably mounted to the facepiece and in fluid communication with the at least one inhalation opening for passage of purified atmospheric air to the facepiece interior chamber;

a self-sealing valve mounted in the at least one inhalation opening and adapted to seal the at least one inhalation opening to prevent inhalation of air therethrough when the filtration canister is removed from the facepiece and to open the at least one inhalation opening to permit inhalation of air therethrough when the filter canister is mounted to the facepiece; and a speech transmitter and exhalation valve module mounted in the at least one exhalation opening and adapted to seal the at least one exhalation opening to prevent inhalation of air therethrough and to open the at least one exhalation opening to permit exhalation of air therethrough, the speech transmitter and exhalation valve module comprising:

a module body having an inner face, an outer face and an outer wall;

a airflow cavity defined by an inner side wall of the module body and extending between openings in the inner and outer faces of the module for fluidly connecting the inner face and the outer face;

an airflow guide positioned within the airflow cavity;

an outlet valve, mounted to the module body and in the airflow cavity, and adapted to close and fluidly seal the airflow cavity during inhalation and to open during exhalation, and wherein inner side wall of the module forms with the airflow guide an airflow channel in the form of a horn expansion contour during exhalation when the outlet valve is in an open position; characterized in that:

an electrical communication block with internal and external fittings for connecting a microphone in the mask to a radio or amplifier carried by the mask user.

28. The respirator of claim 27 wherein the outlet valve further has convex shoulder hinge between the central body and the conical skirt to toggle the outlet valve between an open position and a closed position.

29. The respirator of claim 28 wherein the convex shoulder hinge forms a channel that opens toward the inner face of the module body.

30. A respirator comprising a facepiece defining an interior chamber for filtered air and including at least one inhalation opening for passage of filtered air from the atmosphere to the interior chamber; at least one exhalation opening for passage of air from the interior chamber to the atmosphere; and a filtration canister removably mounted to the facepiece and in fluid communication with the at least one inhalation opening for passage of purified atmospheric air to the facepiece interior chamber;

a self-sealing valve mounted in the at least one inhalation opening and adapted to seal the at least one inhalation opening to prevent inhalation of air therethrough when the filtration canister is removed from the facepiece and to open the at least one inhalation opening to permit inhalation of air therethrough when the filter canister is mounted to the facepiece; and a speech transmitter and exhalation valve module mounted in the at least one exhalation opening and adapted to seal the at least one exhalation opening to prevent inhalation of air therethrough and to open the at least one exhalation opening to permit exhalation of air therethrough, the speech transmitter and exhalation valve module comprising:

a module body having an inner face, an outer face and an outer wall;

a airflow cavity defined by an inner side wall of the module body and extending between openings in the inner and outer faces of the module for fluidly connecting the inner face and the outer face;

an airflow guide positioned within the airflow cavity; and an outlet valve, mounted to the module body and in the airflow cavity, and adapted to close and fluidly seal the airflow cavity during inhalation and to open during exhalation, characterized in that the outlet valve has a dome shape with a central body and a generally conical skirt.

31. The respirator according to claim 30 wherein the outlet valve conical skirt is slightly convex outwardly toward the outer face of the module body.

* * * * *